US008448267B2

(12) United States Patent
Hahn

(10) Patent No.: US 8,448,267 B2
(45) Date of Patent: May 28, 2013

(54) AQUATIC GOGGLES

(76) Inventor: Christian Hahn, Prospect, KY (US)

( * ) Notice: Subject to any disclaimer, the term of this patent is extended or adjusted under 35 U.S.C. 154(b) by 0 days.

(21) Appl. No.: 13/186,291

(22) Filed: Jul. 19, 2011

(65) Prior Publication Data

US 2013/0019386 A1 Jan. 24, 2013

(51) Int. Cl.
*A61F 9/02* (2006.01)

(52) U.S. Cl.
USPC ..... 2/452

(58) Field of Classification Search
USPC ..... 2/452, 431, 432, 426, 427, 442, 445, 2/446, 440; 351/156, 157, 142
See application file for complete search history.

(56) References Cited

U.S. PATENT DOCUMENTS

| | | | | |
|---|---|---|---|---|
| 2,504,524 | A * | 4/1950 | Hayward | 2/445 |
| 4,286,340 | A | 9/1981 | Lathrop | |
| 5,046,200 | A | 9/1991 | Feder | |
| 5,406,340 | A * | 4/1995 | Hoff | 351/156 |
| 5,408,702 | A | 4/1995 | Chiang | |
| 5,642,178 | A * | 6/1997 | Leonardi et al. | 351/111 |
| D391,286 | S * | 2/1998 | Mizusugi | D18/54.1 |
| 6,138,287 | A | 10/2000 | Chou | |
| 6,845,521 | B2 * | 1/2005 | Takeshi et al. | 2/452 |
| 7,992,228 | B2 * | 8/2011 | Milea et al. | 2/448 |
| 2009/0276941 | A1 | 11/2009 | Keegan | |

* cited by examiner

*Primary Examiner* — Tejash Patel
(74) *Attorney, Agent, or Firm* — The Law Offices of Eric W. Peterson

(57) ABSTRACT

The present disclosure pertains to an aquatic goggle for swimming, diving, or the like having a first eyepiece and a second eyepiece where the first eyepiece has a first strap hole and a second eyepiece has a second strap hole, a strap having a first side strap, a second side strap, and a loop having an upper strap with a first end and a second end, a lower strap with a first end and a second end, and at least one support member for preventing the loop from adjusting position.

23 Claims, 4 Drawing Sheets

AQUATIC GOGGLES

BACKGROUND

Aquatic goggles are generally used to isolate eyes of a swimmer from surrounding water and improve underwater vision. Aquatic goggles are worn with a head strap that secures the goggle to the head of the user. During swimming or diving, the head strap often adjusts position thereby diminishing the ability of the head strap to secure the aquatic goggles to the head of the user. Head straps can slide downward causing the aquatic goggles to rest around the neck of the user or slide upward causing the aquatic goggles to fall off the head of the user.

SUMMARY OF THE INVENTION

The present disclosure pertains to an aquatic goggle for swimming, diving, or the like. In one aspect of the disclosure the aquatic goggles have a first eyepiece and a second eyepiece where the first eyepiece has a first strap hole and a second eyepiece has a second strap hole, a strap having a first side strap, a second side strap, and a loop having an upper strap with a first end and a second end, a lower strap with a first end and a second end, and at least one support member for preventing the loop from adjusting position, where the first side strap extends from the first strap hole and engages a first end of the upper strap and a first end of the lower strap, and the second side strap extends from the second strap hole and engages the second end of the upper strap and the second end of the lower strap.

In one aspect of the disclosure the strap has a stretchable section. In one aspect of the disclosure the stretchable section is incorporated into the first side strap. In one aspect of the disclosure the stretchable section is incorporated into the second side strap. In one aspect of the disclosure the stretchable section is incorporated into the upper side strap. In one aspect of the disclosure the stretchable section is incorporated into the lower side strap. In one aspect of the disclosure the strap has four stretchable sections where one stretchable section is incorporated into each of the first side strap, second side strap, upper strap, and lower strap.

In one aspect of the disclosure the strap has an adjustment mechanism to adjust the length of the strap. In one aspect of the disclosure the strap has a friction coating positioned on the internal surface of the strap.

In one aspect of the disclosure the support member has a side portion and an upper portion, where the side portion engages the upper portion thereby creating an engagement point, the side portion extends from the engagement point to a length of the first side strap, and the upper portion extends from the engagement point to a length of the upper strap. In one aspect of the disclosure the support member has a brace that engages the side portion and the upper portion. In one aspect of the disclosure the support member has a lower portion that extends from the engagement point to a length of the lower strap. In one aspect of the disclosure the lower portion tapers as the lower portion extends away from the engagement point. In one aspect of the disclosure the upper portion tapers as the upper portion extends away from the engagement point. In one aspect of the disclosure the support member is incorporated into the interior of the strap. In one aspect of the disclosure the support member engages the exterior of the strap.

In one aspect of the disclosure the aquatic goggles have a first eyepiece and a second eyepiece where the first eyepiece has a first strap hole and a second eyepiece has a second strap hole, and a strap having a first side strap, a second side strap, and a loop of a substantially circular shape having an upper strap with a first end and a second end, a lower strap with a first end and a second end, where the first side strap extends from the first strap hole and engages a first end of the upper strap and a first end of the lower strap, the second side strap extends from the second strap hole and engages the second end of the upper strap and the second end of the lower strap, and the loop is made of material allowing for the loop to conform to the contours of a user's head while maintaining the substantially circular shape.

In one aspect of the disclosure the strap has a flared section for preventing the loop from adjusting position.

BRIEF DESCRIPTION OF THE DRAWINGS

The accompanying drawings, which are incorporated herein and form part of the specification, illustrate various embodiments of the present invention and together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
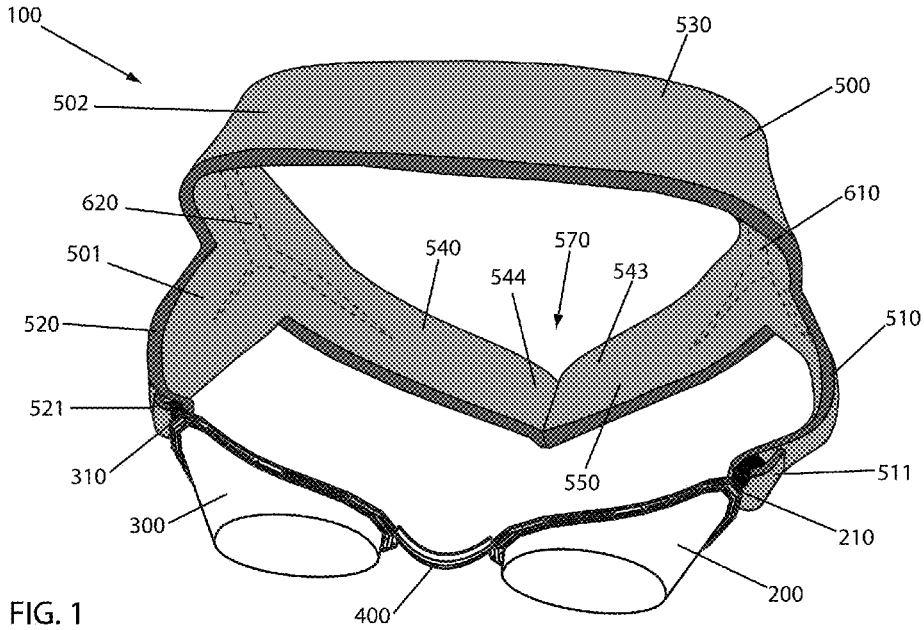
FIG. 1 is a perspective view of aquatic goggles according to an exemplary embodiment.

In the following detailed description, reference is made to the accompanying drawings which form a part hereof and in which is shown by way of illustration specific embodiments in which the invention may be practiced. These embodiments are described in sufficient detail to enable those skilled in the art to practice the invention, and it is to be understood that other embodiments may be utilized and that structural or logical changes may be made without departing from the scope of the present invention. The following detailed description is, therefore, not to be taken in a limiting sense, and the scope of the present invention is defined by the appended claims.

The present disclosure pertains to aquatic goggles 100 for swimming, diving, or the like. In one embodiment, the aquatic goggles 100 have a first eyepiece 200, a second eyepiece 300, a nosepiece 400, and a strap 500.

The first eyepiece 200 and second eyepiece 300 protect the eyes of the user from contacting water. During use, the first eyepiece 200 and second eyepiece 300 extend over the eyes and contact the face to provide the user with an eye-air interface. As shown in FIG. 1, the first eyepiece 200 has a first strap hole 210 for allowing the strap 500 to pass through the first strap hole 210 thereby engaging the first eyepiece 200. The second eyepiece 300 has a second strap hole 310 for allowing the strap 500 to pass through the second strap hole 310 thereby engaging the second eyepiece 300. The nosepiece 400 couples the first eyepiece 200 to the second eyepiece 300 and extends between the first eyepiece 200 and the second eyepiece 300.

The strap 500 retains the first eyepiece 200 and the second eyepiece 300 to the head of the user. The strap 500 has an interior surface 501 that rests against the head of the user and an exterior surface 502. In one embodiment, the strap 500 has a loop with a first side strap 510 with end 511 and end 512, a second side strap 520 with end 521 and end 522, an upper strap 530 with a first end 531 and a second end 532, and a lower strap 540 with a first end 541 and a second end 542. The first side strap 510 extends from the first strap hole 210 and engages the first end 531 of the upper strap 530 and the first end 541 of the lower strap 540. The second side strap 520 extends from the second strap hole 310 and engages the second end 532 of the upper strap 530 and the second end 542 of the lower strap 540. In one embodiment, end 511 of the first side strap 510 passes through the first strap hole 210 and engages the first side strap 510, while the second side strap 520 passes through the second strap hole 310 and engages the second side strap 520. The engagement of the end 511 with the first side strap 510 and the end 521 with the second side strap 520 can be a fixed or adjustable engagement.

In one embodiment, the strap 500 can be made of any material that allows for the strap 500 to retain the first eyepiece 200 and second eyepiece 300 to the face, for example, without limitation, elastomers, synthetic rubbers, neoprene, or the like. In one embodiment, the loop can be made of any material allowing the loop to conform to the contours of a user's head while maintaining a substantially circular shape, for example, without limitation, neoprene, or the like.

In one embodiment, as shown in FIG. 1, the strap 500 contains a friction coating 550 for preventing the strap 500 from adjusting position. The friction coating 550 can be any friction creating material that lines the interior surface 501 of the strap 500, for example, without limitation, rubber, neoprene, or the like.

Figure 2:
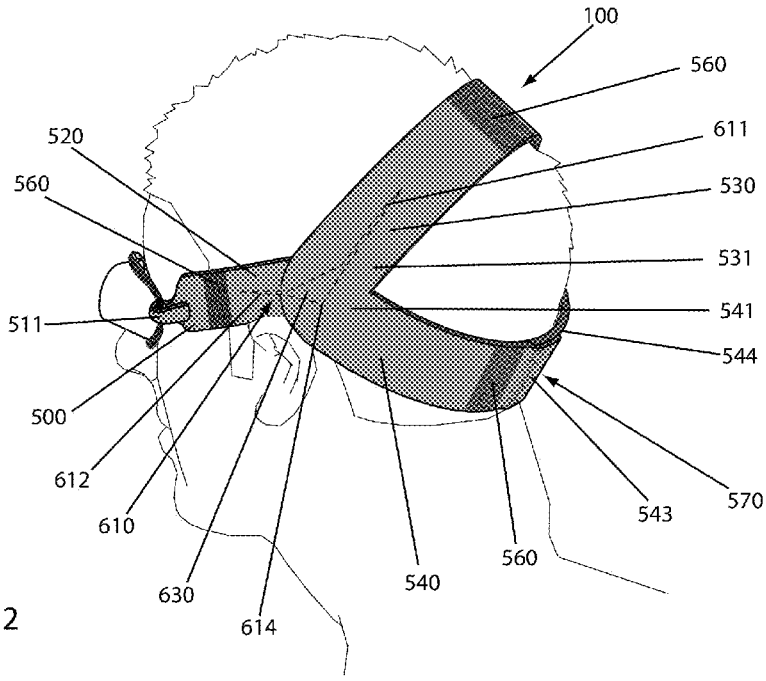
FIG. 2 is a perspective view of aquatic goggles according to an exemplary embodiment.

In one embodiment, as shown in FIG. 2, the strap 500 contains at least one stretchable section 560 to allow for the head of the user to be of different sizes. The stretchable section 560 can be made of any material that allows for the length of the stretchable section 560 to expand and retract, for example, without limitation, elastomers, synthetic rubbers, or the like. The stretchable section 560 can be incorporated into the first side strap 510, second side strap 520, upper strap 530, lower strap 540, or any combination thereof. In the preferred embodiment, the strap 500 has four stretchable sections 550 wherein one stretchable section 560 is incorporated into each of the first side strap 510, second side strap 520, upper strap 530, and lower strap 540. The stretchable section 560 can be any length that allows for the strap 500 to adjust to all sized heads of the user.

In one embodiment, as shown in FIG. 1, the strap 500 has an adjustment mechanism 570 to adjust the length of the strap 500 to accommodate all sized heads of the user. The adjustment mechanism 570 allows the upper strap 530 or lower strap 540 to be lengthened or shortened, thereby increasing or decreasing the diameter of the loop created by the upper strap 530 and lower strap 540. The adjustment mechanism 570 is any conventional mechanism that connects two ends together. For example, without limitation, the adjustment mechanism 570 can be a male and female connector, a series of snap buttons, a hook and loop, or the like. By way of example, without limitation, where the adjustment mechanism 570 is a hook and loop that is incorporated into the lower strap 540, the lower strap 540 has first adjustment end 543 with a strip of hook and second adjustment end 544 with a strip of loop. The strip of hook can be place at a position on the strip of loop thereby increasing or decreasing the length of the lower strap 540.

Figure 6:
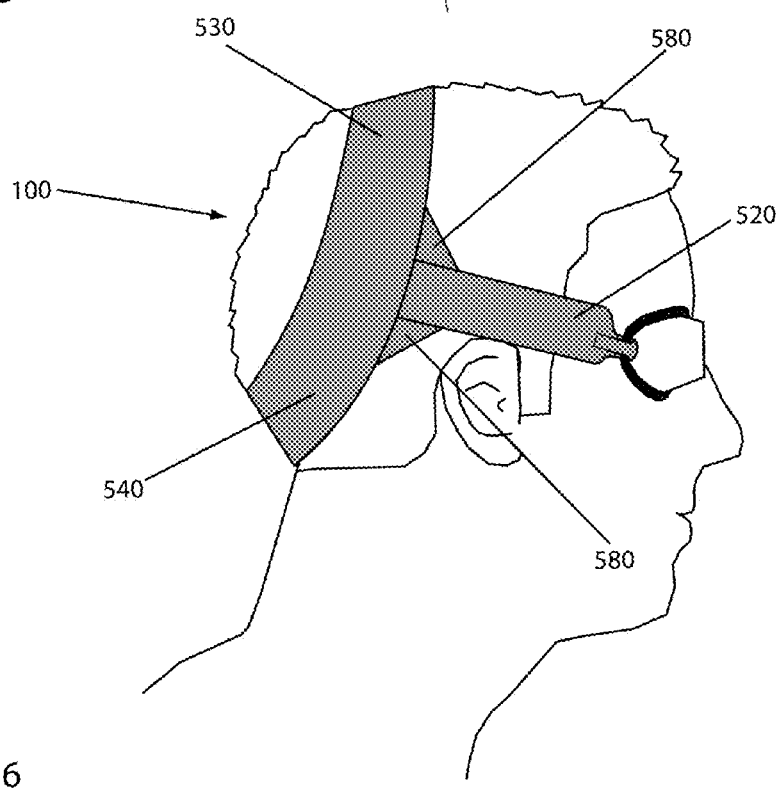
FIG. 6 is a perspective view of aquatic goggles according to an exemplary embodiment.

In one embodiment, the side strap has a flared section 580 for providing stability to the strap thereby preventing the loop, including the upper strap 530 and lower strap 540, from adjusting position in relation to the lower strap 540 and the upper strap 540, respectively, for example, without limitation, preventing the upper strap 530 from sliding down the back of the head or preventing the lower strap 540 from sliding up the back of the head. As shown in FIG. 6, for example, without limitation, the flared section 580 can be located at end 512 of the first side strap 510 and end 522 of the second side strap 520 where the width of the first side strap 510 and the second side strap 520 increases as the side straps extend toward the loop.

Figure 7:
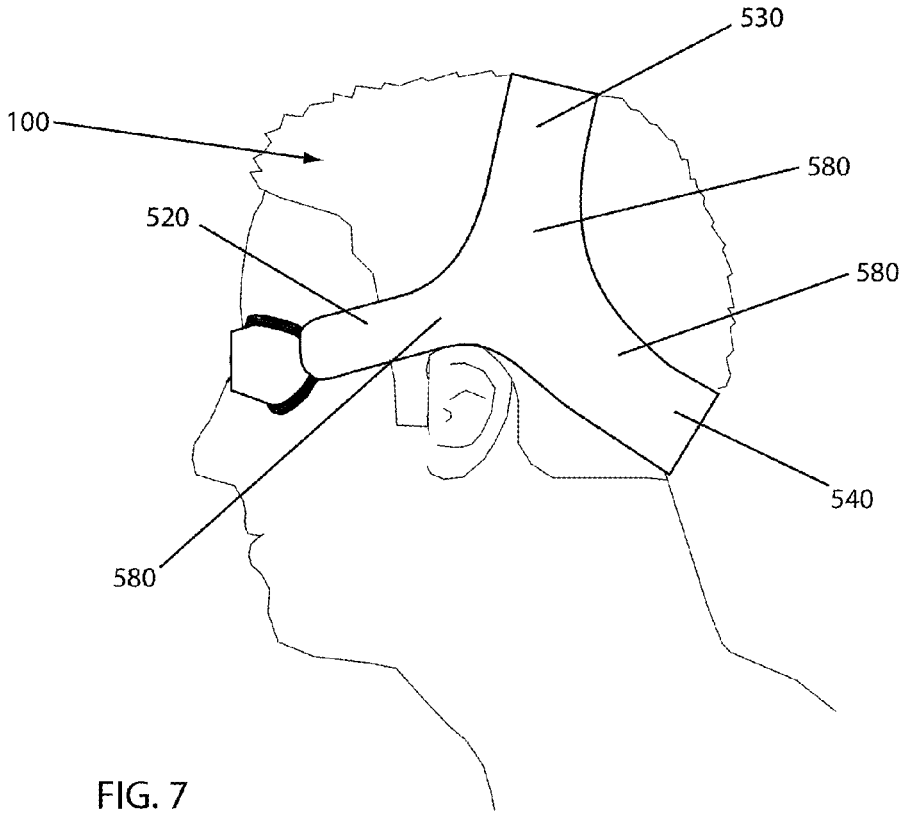
FIG. 7 is a perspective view of aquatic goggles according to an exemplary embodiment.

In one embodiment, as shown in FIG. 7, for example, without limitation, the upper strap 530 and lower strap 540 have a flared section 580 for providing stability to the straps thereby preventing the loop, including the upper strap 530 and lower strap 540, from adjusting position in relation to the lower strap 540 and the upper strap 540, respectively, for example, without limitation, preventing the upper strap 530 from sliding down the back of the head or preventing the lower strap 540 from sliding up the back of the head. The upper strap 530 has a flared section 580 where the width of the upper strap 530 increases as the upper strap 530 extends toward the side strap 520. The lower strap 540 has a flared section 580 where the width of the lower strap 540 increases as the lower strap 540 extends toward the side strap 520.

In one embodiment, the aquatic goggles 100 have at least one support member 600 for preventing the loop, including the upper strap 530 and lower strap 540, from adjusting position in relation to the lower strap 540 and the upper strap 540, respectively, for example, without limitation, preventing the upper strap 530 from sliding down the back of the head or preventing the lower strap 540 from sliding up the back of the head. The support member 600 can be made of any rigid material that prevents the movement of the upper strap 530, for example, without limitation, rigid plastic, rigid rubber, rigid silicone, metal, or the like. In one embodiment, the support member 600 is incorporated into the interior of the strap 500. In one embodiment, the support member 600 engages an external surface, for example, without limitation, the interior surface 501 or the exterior surface 502, of the strap 500. The support member 600 can engage the external surface of the strap by any conventional means that secures one member to another, for example, without limitation, gluing, sewing, melting, or the like.

In the preferred embodiment, the aquatic goggles 100 have two support members 600, a first support member 610 and a second support member 620. The first support member 610 is incorporated into the first side strap 510 and upper strap 530, or the first side strap 510, upper strap 530, and lower strap 540, and the second support member 620 is incorporated into the second side strap 520 and upper strap 530, or the second side strap 520, upper strap 530, and lower strap 540.

Figure 3:
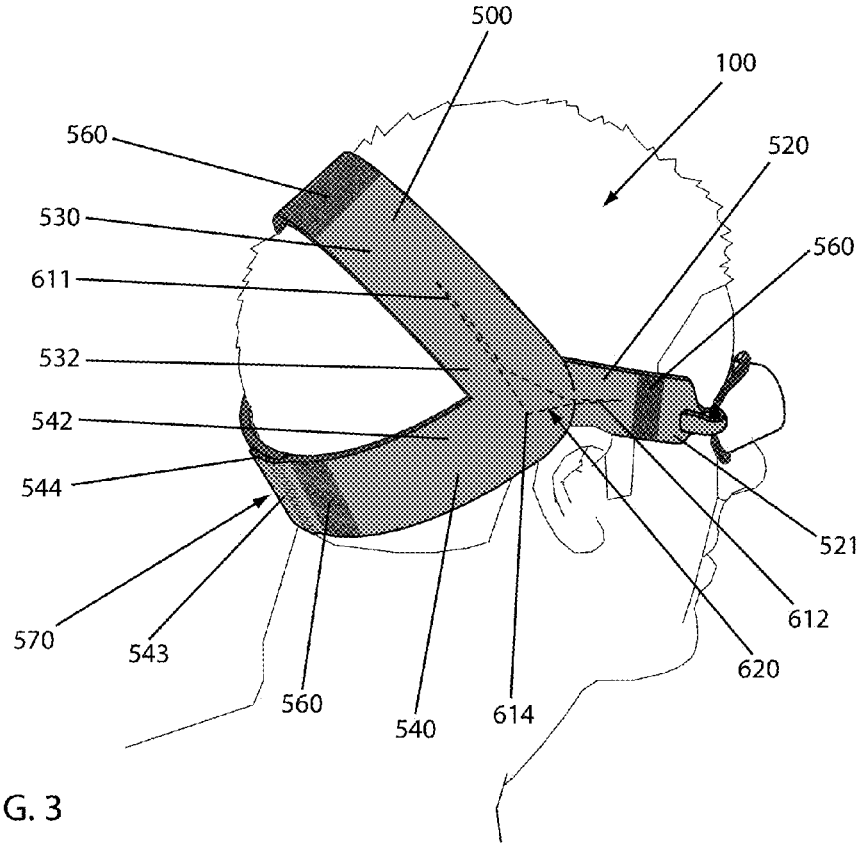
FIG. 3 is a perspective view of aquatic goggles according to an exemplary embodiment.

In one embodiment, as shown in FIGS. 2 and 3, the support member 600 can have an upper portion 611 for preventing the upper strap 530 from adjusting position and a side portion 612 for assisting the upper portion 611 in preventing the upper strap 530 from adjusting position. The side portion 612 engages the upper portion 611 thereby creating an engagement point 614. The side portion 612 extends from the engagement point 614 to a length of the first side strap 510 or second side strap 520 and the upper portion 611 extends from the engagement point 614 to a length of the upper strap 530. While the upper portion 611 can be any length that prevents the upper strap 530 from adjusting position, the upper portion 611 is preferably 3". While the side portion 612 can be any length that assists the upper portion 611 in preventing the upper strap 530 from adjusting position, the side portion 612 is preferably 4.5 cm in length.

Figure 4:
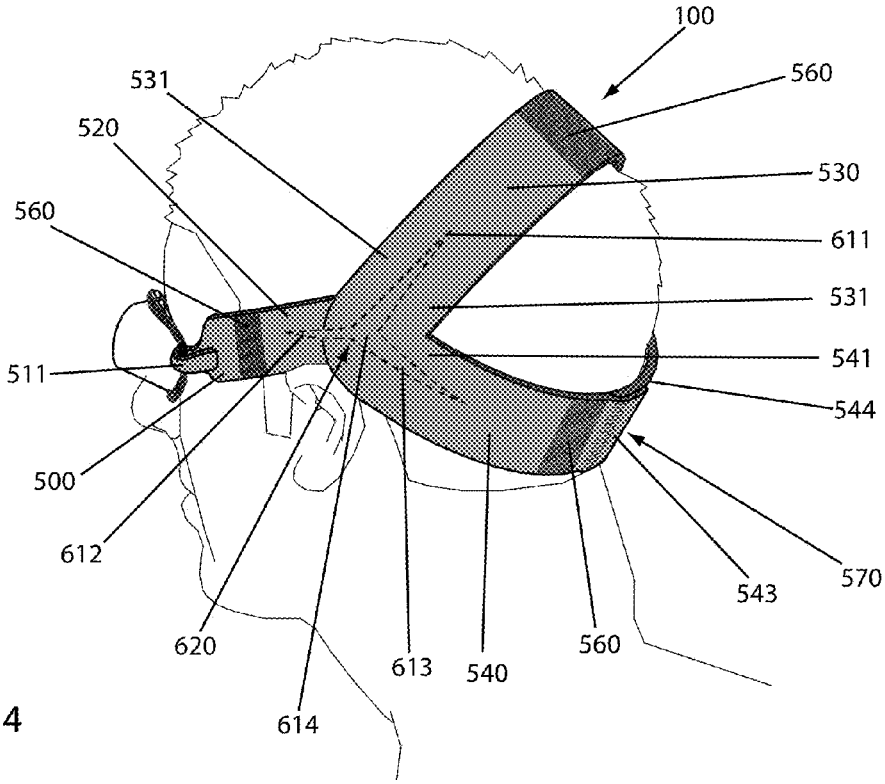
FIG. 4 is a perspective view of aquatic goggles according to an exemplary embodiment.
Figure 5:
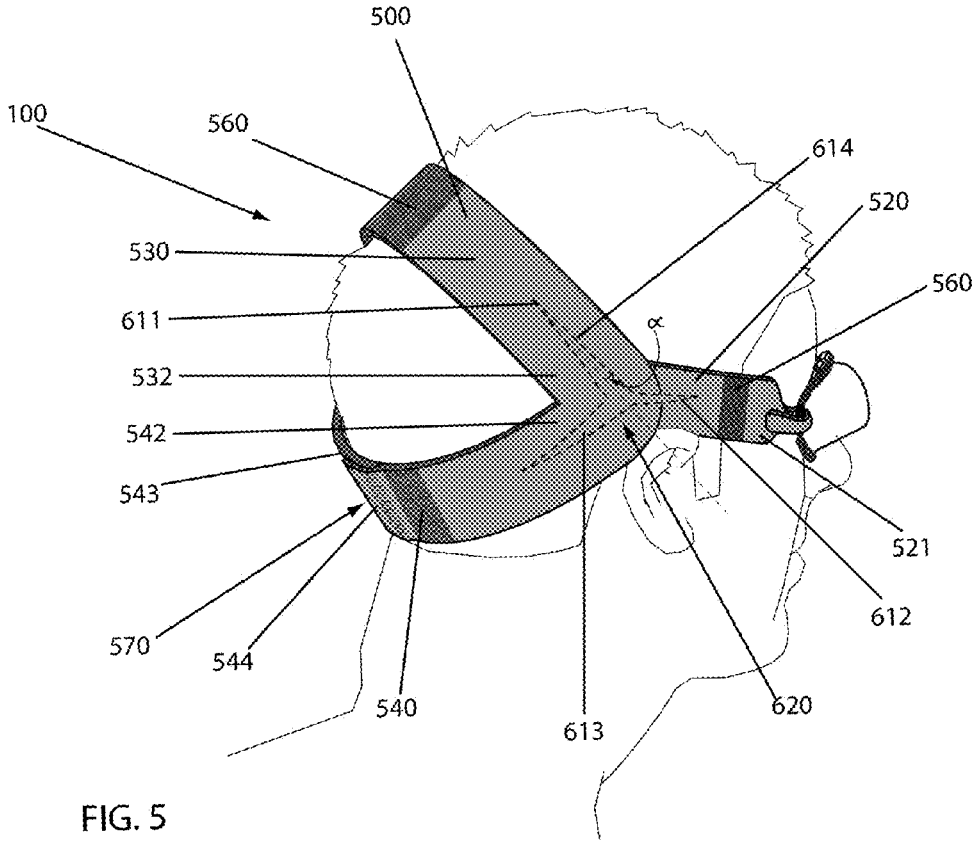
FIG. 5 is a perspective view of aquatic goggles according to an exemplary embodiment.

In one embodiment, as shown in FIGS. 4 and 5, the support member 600 can also have a lower portion 614 that assists the upper portion 611 in preventing the upper strap 530 from adjusting position. The upper portion 611, side portion 612, and lower portion 614 are engaged together and radiate from the engagement point 614 similar to a spoke radiating from the hub of a wheel. The lower portion 614 extends from the engagement point 614 to a length of the lower strap 540. While the lower portion 614 can be any length that assists the upper portion 611 in preventing the upper strap 530 from adjusting position, the lower portion 614 is preferably 4 cm.

In one embodiment, the support member 600 has at least one brace 630 that provides additional rigidity to the support member 600. As shown in FIGS. 2 and 3, the brace 630 can engage the side portion 612 and the upper portion 611, the side portion 612 and the lower portion 614, and/or the upper portion 611 and the lower portion 614. The brace 630 can be made of any rigid material that prevents movement of the upper strap 530, for example, without limitation, plastic, metal, or the like. In one embodiment, as shown in FIGS. 4 and 5, the upper portion 611, side portion 612, and/or lower portion 614 taper as the upper portion 611, side portion 612, and/or lower portion 614 extend away from the engagement point 614 thereby providing additional rigidity to the support member 600. While the upper portion 611, side portion 612, and lower portion 614 can taper at any angle $\alpha$, the angle $\alpha$ is preferably 10°.

The foregoing has described the principles, embodiments, and modes of operation of the present invention. However, the invention should not be construed as being limited to the particular embodiments described above, as they should be regarded as being illustrative and not as restrictive. It should be appreciated that variations may be made in those embodiments by those skilled in the art without departing from the scope of the present invention.

Modifications and variations of the present invention are possible in light of the above teachings. It is therefore to be understood that the invention may be practiced otherwise than as specifically described herein.

What is claimed is:

1. Aquatic goggles comprising:

a first eyepiece and a second eyepiece wherein the first eyepiece has a first strap hole and a second eyepiece has a second strap hole, a strap having at least one side strap and a loop, the loop having an upper strap with a first end and a second end and a lower strap with a first end and a second end, and at least one support member extending about the loop for preventing the loop from adjusting position, wherein the at least one side strap extends from the first strap hole and engages a first end of the upper strap and a first end of the lower strap.

2. The aquatic goggles of claim 1 wherein the strap comprises a stretchable section.

3. The aquatic goggles of claim 2 wherein the stretchable section is incorporated into the first side strap.

4. The aquatic goggles of claim 2 wherein the stretchable section is incorporated into the second side strap.

5. The aquatic goggles of claim 2 wherein the stretchable section is incorporated into the upper side strap.

6. The aquatic goggles of claim 2 wherein the stretchable section is incorporated into the lower side strap.

7. The aquatic goggles of claim 2 wherein the strap comprises four stretchable sections wherein one stretchable section is incorporated into each of the first side strap, second side strap, upper strap, and lower strap.

8. The aquatic goggles of claim 1 wherein the strap comprises an adjustment mechanism to adjust the length of the strap.

9. The aquatic goggles of claim 1 wherein the strap comprises a friction coating positioned on the internal surface of the strap.

10. The aquatic goggles of claim 1 wherein the support member comprises a side portion and an upper portion, wherein the side portion engages the upper portion thereby creating an engagement point, the side portion extends from the engagement point to a length of the first side strap, and the upper portion extends from the engagement point to a length of the upper strap.

11. The aquatic goggles of claim 10 wherein the support member further comprises a brace that engages the side portion and the upper portion.

12. The aquatic goggles of claim 10 wherein the support member further comprises a lower portion that extends from the engagement point to a length of the lower strap.

13. The aquatic goggles of claim 12 wherein the lower portion tapers as the lower portion extends away from the engagement point.

14. The aquatic goggles of claim 10 wherein the upper portion tapers as the upper portion extends away from the engagement point.

15. The aquatic goggles of claim 1 wherein the support member is incorporated into the interior of the strap.

16. The aquatic goggles of claim 1 wherein the support member engages the exterior of the strap.

17. Aquatic goggles comprising:

a first eyepiece and a second eyepiece wherein the first eyepiece has a first strap hole and a second eyepiece has a second strap hole, and a strap having an at least one side strap having a flared section and a loop of a substantially circular shape, the loop having an upper strap with a first end and a second end and a lower strap with a first end and a second end, the flared section engages a portion of the upper strap and engages a portion of the lower strap, and the loop is made of material allowing for the loop to conform to the contours of a user's head while maintaining the substantially circular shape.

18. The aquatic goggles of claim 17 wherein the strap comprises a flared section for preventing the loop from adjusting position.

19. The aquatic goggles of claim 17 wherein the strap comprises a stretchable section.

20. The aquatic goggles of claim 19 wherein the stretchable section is incorporated into the first side strap.

21. The aquatic goggles of claim 19 wherein the stretchable section is incorporated into the second side strap.

22. The aquatic goggles of claim 17 wherein the strap comprises a friction coating positioned on the internal surface of the strap.

23. The aquatic goggles of claim 1 wherein the at least one side strap has a flared section, the flared section engaging a portion of the upper strap and engaging a portion of the lower strap.

* * * * *